United States Patent [19]

Harwood et al.

[11] Patent Number: 4,760,894

[45] **Date of Patent: * Aug. 2, 1988**

[54] EXHAUST MUFFLER WITH ANGULARLY ALIGNED INLETS AND OUTLETS

[75] Inventors: Jon W. Harwood; James W. Emrick; Bruno A. Rosa; Bruce G. Kratzer, all of Toledo, Ohio

[73] Assignee: AP Industries, Inc., Toledo, Ohio

[ * ] Notice: The portion of the term of this patent subsequent to Oct. 20, 2004 has been disclaimed.

[21] Appl. No.: 61,876

[22] Filed: Jun. 11, 1987

[51] Int. Cl.[4] ..... F01N 1/02; F01N 7/18

[52] U.S. Cl. ..... 181/282; 181/228; 181/239; 181/250; 181/266; 181/272

[58] Field of Search ..... 181/227, 228, 239, 241–255, 181/266, 269, 272, 276, 282

[56] References Cited

U.S. PATENT DOCUMENTS

| | | | |
|---|---|---|---|
| 2,484,827 | 10/1949 | Harley . | |
| 2,860,722 | 11/1958 | Gerstung . | |
| 2,943,695 | 7/1960 | Jeffords | 181/243 |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,638,756 | 2/1972 | Thiele | 181/245 |
| 3,688,476 | 9/1972 | Lenane | 181/228 X |
| 4,108,274 | 8/1978 | Snyder | 181/229 |
| 4,132,286 | 1/1979 | Hasui et al. | 181/265 |
| 4,396,090 | 8/1983 | Wolfhugel | 181/282 |
| 4,422,519 | 12/1983 | Nomura et al. | 181/228 X |
| 4,456,091 | 6/1984 | Blanchot | 181/282 |
| 4,700,806 | 10/1987 | Harwood | 181/282 |

FOREIGN PATENT DOCUMENTS

| | | |
|---|---|---|
| 59-155528 | 9/1984 | Japan . |
| 59-43456 | 12/1984 | Japan . |
| 61155625 | 3/1985 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—B. R. Fuller

*Attorney, Agent, or Firm*—Anthony J. Casella; Gerald E. Hespos

[57] ABSTRACT

An exhaust muffler is provided. The muffler may be formed from a pair of internal plates that are secured in registration with one another and are formed to define an array of tubes through which the exhaust gages may travel. Selected portions of the tubes in the internal plates may be formed to include perforations. The muffler may further include at least one external shell formed to define at least one chamber which may at least partly surround the perforations in the internal plates. At least one inlet or outlet may lie on the seam between the formed plate members. However, at least one inlet or outlet may also be provided through a portion of the muffler spaced from the seams. The inlet and/or the outlet may be angularly aligned to the longitudinal axis of the muffler and may further be angularly aligned to one another.

25 Claims, 4 Drawing Sheets

FIG. 1
PRIOR ART
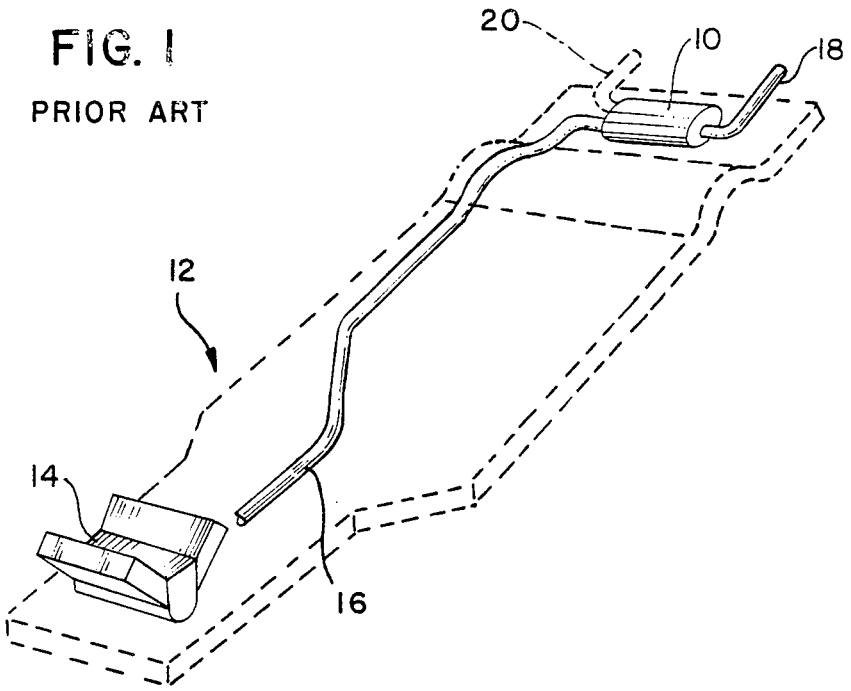
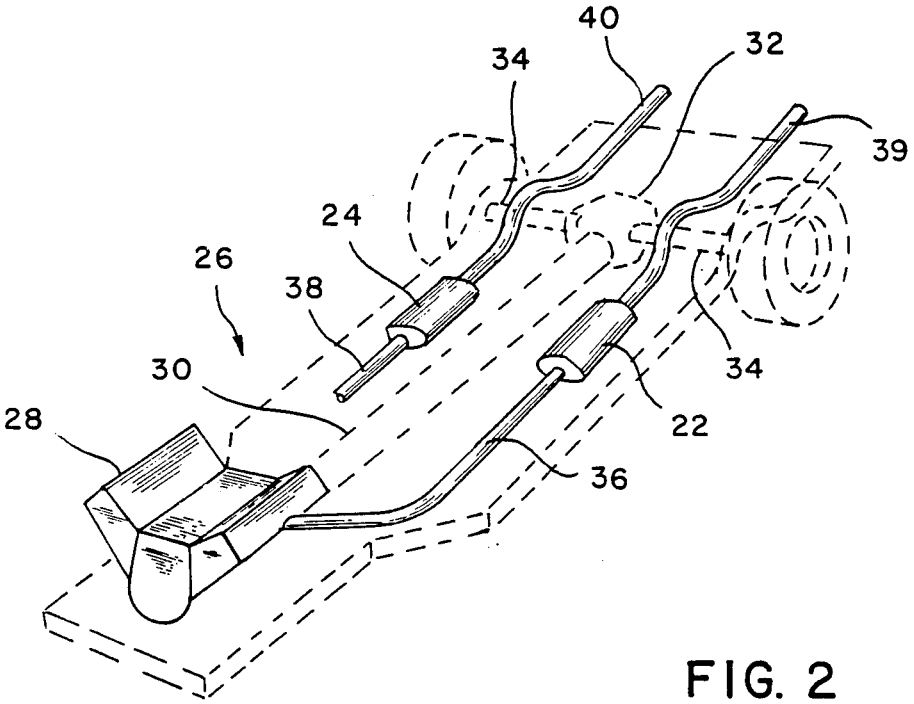
FIG. 2
PRIOR ART

FIG. 5
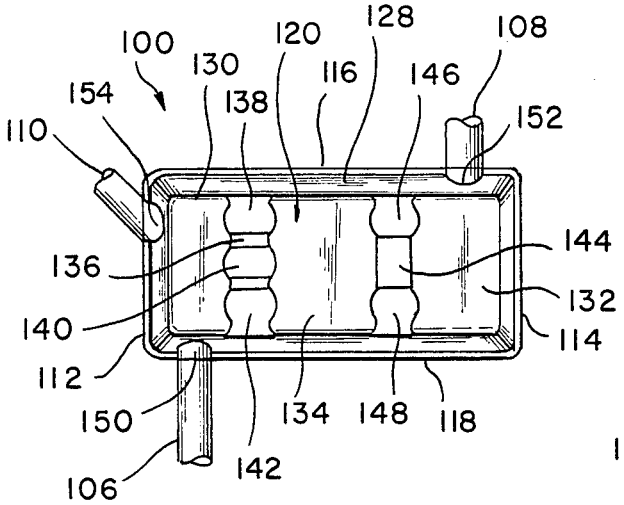
FIG. 6
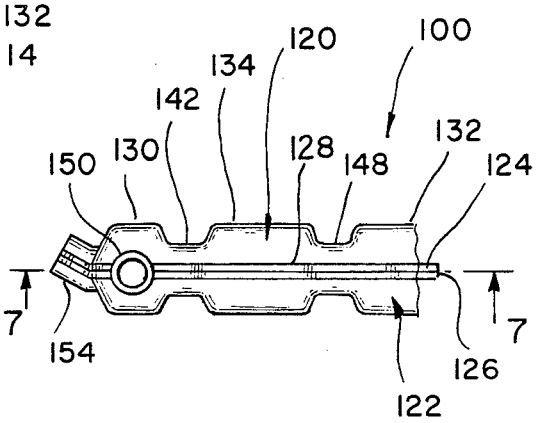
FIG. 7
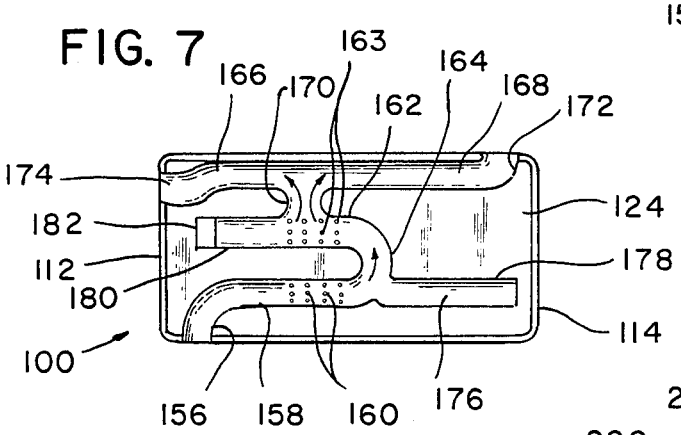
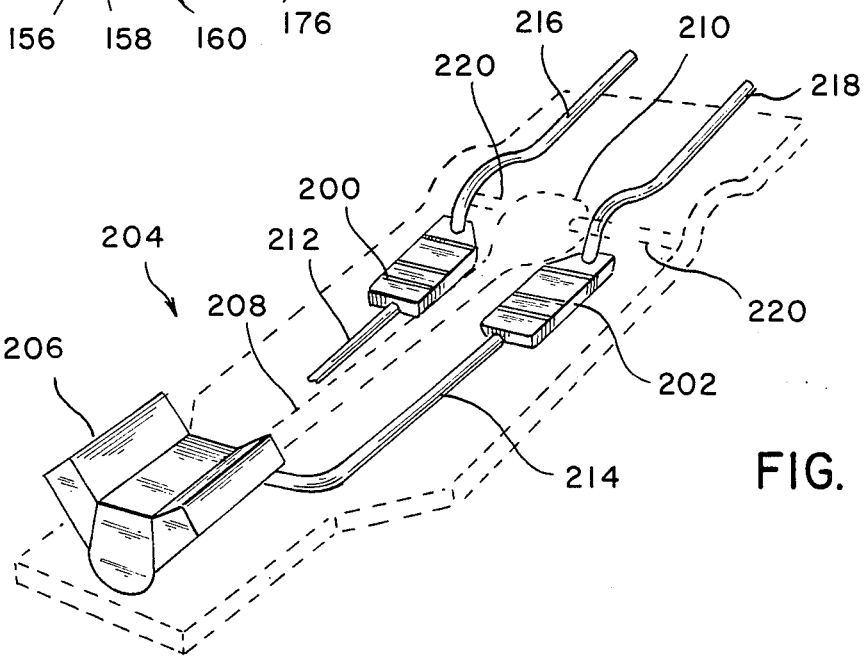
FIG. 8

EXHAUST MUFFLER WITH ANGULARLY ALIGNED INLETS AND OUTLETS

RELATED APPLICATIONS

This application is related to U.S. Patent Application Ser. No. 934,642 filed Nov. 25, 1986, now U.S. Pat. No. 4,700,806, entitled "STAMP FORMED MUFFLER" by Jon Harwood and U.S. Patent Application Ser. No. 061,913 filed concurrently with this application and entitled "TUBE AND CHAMBER CONSTRUCTION FOR AN EXHAUST MUFFLER" by Jon Harwood et al. Both of said co-pending applications are assigned to the assignee of the subject application. The disclosures of these co-pending applications are incorporated herein by reference.

BACKGROUND OF THE INVENTION

The prior art vehicular exhaust muffler typically is an elongated structure with a constant oval or circular cross section along its length. The exterior of this prior art exhaust muffler includes one or more sheets of metal wrapped into an oval or circular cross-section and secured by a longitudinally extending seam.

The internal components of the prior art exhaust muffler comprise a plurality of parallel tubes supported by transverse baffles having generally the same oval or circular shape as the wrapped outer shell. The baffles meet the inner surface of the wrapped outer shell to define chambers within the muffler. Portions of certain tubes in the prior art muffler are perforated to permit a controlled flow of exhaust gases into or out of the chambers.

A pair of heads are mechanically connected to the opposed longitudinal ends of the wrapped outer shell to enclose the prior art muffler. The two heads have a total of at least two apertures extending therethrough. Short longitudinally extending tubular nipples extend through the apertures in the heads of the prior art muffler to mate with either the tubes or chambers inside the muffler. At least one nipple defines the inlet and is connected to the exhaust pipe of the vehicle, while at least one other nipple defines an outlet connectable to the tail pipe. Most prior art mufflers have a single inlet at one longitudinal end of the muffler and a single outlet at the opposed longitudinal end. However, many mufflers include more than one inlet and/or more than one outlet.

The arrangement of tubes and baffles in the prior art muffler depends on the noise characteristics of the engine, the required amount of noise attenuation and the amount of back pressure considered acceptable. A circuitous flow path for the exhaust gases is created by the baffles and tubes to attenuate the engine noise sufficiently without creating too great a back pressure. For example, reversals of the flow of gases could be achieved with the prior art mufflers by extending an inlet tube into a reversing chamber formed by one or more transverse baffles, and by having a return tube communicate with the same reversing chamber. The exhaust gases might thus flow through the inlet tube into the reversing chamber and out the return tube. A second reversing chamber could be disposed at the opposite end of the muffler to enable the exhaust gases to flow from the return tube into the outlet tube of the muffler. A cross flow of the exhaust gases could be achieved by perforating tubes in certain chambers formed by transverse baffles in the muffler. Transverse baffles also could define a resonating chamber into which a tuning tube would extend. The dimensions of the tuning tube and the resonating chamber would be selected to dampen a particular range of frequencies of exhaust gas noises.

One of the more difficult design restraints for exhaust systems is the limited available space on the vehicle. The size and the shape of the available space envelope on the underside of the vehicle invariably affects both the size of the muffler and the possible alignments of the exhaust pipe and tail pipe leading to and from the muffler. In many situations a muffler must be smaller than the available space envelope on the vehicle to allow sufficient room for smooth bends of the pipes leading to or from the opposed heads of the muffler. The reduction in size of the muffler to accommodate the available space on the underside of the vehicle invariably makes the design of the internal components of the muffler more difficult.

Certain vehicles include a convenient space for the transverse mounting of a muffler. However, with the prior art muffler, transverse mounting would require substantial bends in both the exhaust pipe and tail pipe in the vicinity of the muffler. These bends must have a large enough radius to avoid an unacceptable back pressure. However, large bends require additional costly tubing, and must compete for space with other vehicular components.

Certain other vehicles include a convenient space for a muffler just forward of the rear axle. However, the tail pipe extending from the head of prior art muffler to the rear of the vehicle must bend over the top of the rear axle. Thus, the muffler must be spaced a sufficient distance forward of the rear axle to enable the tail pipe to bend upwardly and over the rear axle. As a result, available space forward of the rear axle can not be used by the prior art muffler.

In situations where the available space was especially limited, muffler manufacturers have reinforced sections of the wrapped outer shell of the prior art muffler and formed an aperture through the reinforced portion of the wrapped outer shell. A nipple was then placed in the aperture in the reinforced portion of the wrapped outer shell and welded in position. This nipple typically would extend into a chamber in the muffler. In this type of prior art muffler, one of the opposed heads might be free of apertures extending into the muffler. The additional reinforcing material and the manufacturing steps for reinforcing the outer wrapper, forming an aperture therein and welding the nipple in place, created substantial time and cost penalties for these prior art mufflers. As a result, this prior art muffler was used primarily in isolated instances where all other conventional techniques were unacceptable and where high costs could be tolerated.

Certain mufflers have been manufactured substantially entirely from tubular components. The most common muffler employing all tubular components is referred to as the glass pack muffler, and typically includes a single linear louvered tube extending the length of the muffler and a tubular outer shell surrounding the louvered tube. The tubular outer shell is spaced from the central louvered portion of the tube, but is tightly engaged to the tube adjacent the opposed ends. The space between the louvered portion of the inner tube and the tubular outer shell is filled with a fiberglass material having sound insulating characteristics. Glass pack mufflers typically are employed on high performance cars where it is desirable to minimize back pressure and where higher noise levels are acceptable. U.S. Pat. No. 3,412,825 which issued to James Hall on Nov. 26, 1968 shows a glass pack muffler with the tubes angled relative to the centerline of the muffler to facilitate the connection of the glass pack muffler to the exhaust pipe or tail pipe of the vehicle.

Mufflers consisting entirely of stamp formed components have been designed recently. The typical stamp formed muffler consists of two stamp formed shells which are configured to define a convoluted path through which the exhaust gases must travel. Examples of such stamp formed mufflers include U.S. Pat. No. 2,484,827 which issued to Harley and U.S. Pat. No. 3,638,756 which issued to Thiele. Other stamp formed mufflers have included a plurality of stamp formed components, including a pair of stamp formed outer shells and one or more stamp formed internal components which are intended to create a convoluted path through which the exhaust gases travel. Examples of mufflers of this general type are shown in: British Pat. No. 1,012,463 which issued to Woolgar on Dec. 8, 1965; British Pat. No. 632,013 which issued to White in 1949; U.S. Pat. No. 4,132,286 which issued to Hasui et al on Jan. 2, 1979; U.S. Pat. No. 4,396,090 which issued to Wolfhugel on Aug. 2, 1983; and U.S. Pat. No. 4,456,091 which issued to Blanchot on June 26, 1984.

A particularly desirable muffler formed entirely from stamp formed components is shown in U.S. patent application Ser. No. 934,642 filed Nov. 25, 1986 now U.S. Pat. No. 4,700,806 by Jon Harwood, and is assigned to the assignee of the subject invention. U.S. Pat. No. 4,700,806 shows mufflers formed from a pair of plates that are stamp formed to define channels, portions of which are perforated, and to form at least one tuning tube. The muffler of U.S. Pat. No. 4,700,806 further includes at least one outer shell which is stamp formed to define at least one expansion chamber to surround the perforated channels. Additionally, the stamp forming of the muffler components further defines at least one low frequency resonating chamber which communicates with the tuning tube formed by the stamp formed plates.

All of the above described stamp formed mufflers have been designed with inlets and outlets extending into the opposed longitudinal ends of the muffler. As a result, despite the many advantages of stamp formed mufflers, the known stamp formed mufflers have embodied the same structural limitations as the prior art mufflers having wrapped outer shells. In particular, these known stamp formed mufflers often would require sufficient room for the exhaust pipe and/or tail pipe to undergo one or more large bends to approach the muffler along a line generally parallel to the longitudinal axis of the muffler. As a result, the costs associated with the tubes for such mufflers would be unnecessarily high, and the mufflers often could not make use of all of available space on the vehicle in view of the need to leave room for bends in the exhaust pipe or tail pipe.

In view of the above, it is an object of the subject invention to provide a stamp formed muffler that can substantially facilitate the design and alignment of the exhaust pipe and tail pipe for the vehicle.

Another object of the subject invention is to provide a stamp formed muffler that can accommodate a greater proportion of the available space on the vehicle.

A further object of the subject invention is to provide a stamp formed muffler having an inlet angularly aligned to an outlet thereof to facilitate the connections to exhaust pipes and/or tail pipes.

Still another object of the subject invention is to provide a stamp formed muffler having an inlet or outlet extending through a top or bottom wall of the muffler.

A further object of the subject invention is to provide an exhaust system having a low overall cost.

SUMMARY OF THE INVENTION

The subject invention is directed to an exhaust muffler formed from components that preferably are stamp formed or molded from a suitable material. In the typical embodiment, as described herein, the muffler will be constructed from metal sheets which are stamp formed to define the required shape. However, it is also envisioned that the muffler may be molded from a suitable plastic. The muffler may be of any rectangular or non rectangular shape to fit the available space on the vehicle. The muffler may be generally elongated, and the components of the muffler may be formed to enable at least one exhaust pipe or tail pipe to enter the muffler at an angle to the longitudinal axis of the muffler. Additionally, the forming may enable exhaust pipes and tail pipes to be angularly aligned to one another where they enter the muffler.

The exhaust muffler of the subject invention may comprise a pair of plates formed by stamping, molding or such and which are placed in face to face relationship with one another. The forming is such that the pair of plates define a tubular array including at least one inlet and at least one outlet. The inlet and outlet defined by the forming of the plates are in communication with one another either directly through the tubular array or through chambers of the muffler to enable a flow of exhaust gases from the inlet to the outlet. Selected portions of the tubular array may be perforated to enable the flow of exhaust gases into or through expansion chambers, as explained further below. The plates may further be formed to define one or more tuning tubes communicating with the inlet, the outlet or any tube extending therebetween.

The muffler further comprises at least one external shell that is stamp formed, molded or otherwise formed into the required configuration. The formed external shell is configured to define at least one expansion chamber dimensioned to surround and substantially enclose perforations in the formed tubes of the plates. In certain embodiments the external shell may be formed to define a plurality of separate expansion chambers surrounding selected arrays of perforations in the tubes. The external shell may further define a low frequency resonating chamber which communicates with a tuning tube stamp formed in the plates.

In certain embodiments, the muffler will include a pair of stamp formed or molded external shells which are mounted respectively to the two formed plates. The pair of external shells may be symmetrical with one another, but such symmetry is not required.

The external shell of the subject muffler is secured to the formed plates and/or to any other external shell on the muffler. The attachment of the external shell to the formed plates and/or to the other external shell will define a seam that may lie within a single plane. The communication between the inlet of the muffler and the exhaust pipe of the vehicle may be at a location on the seam between the members of the muffler. Similarly, the communication between the outlet of the muffler and the tail pipe of the vehicle may also be on a seam between the various formed members of the muffler. In these embodiments, the subject muffler may be an elongated structure, and the inlet and/or the outlet may be angularly aligned to the longitudinal axis of the muffler. Additionally, at least one inlet of the muffler may be angularly aligned and/or physically offset from at least one other inlet or outlet of the muffler.

At least one inlet and/or outlet of the muffler may be spaced from the seam between the various formed members of the muffler. In particular, at least one plate may be formed such that a tubular inlet or outlet portion is defined at a location away from the peripheral edges of the plate. This tubular portion stamp formed into one or more plates will communicate with the array of tubes defined when the plates are mated to one another. The external shell will then be formed to define an aperture to be placed in register with the tubular outlet of the plate. An appropriate nipple may then be welded to the tubular portion of the plate. This configuration offers many substantial advantages in designing the exhaust system for a vehicle. In particular, this configuration enables the muffler to extend a greater distance toward an obstruction over or under which the exhaust pipe or tail pipe must pass. The muffler may assume larger dimensions, thereby enabling a greater amount of tuning to be performed within the muffler while simultaneously keeping back pressure low.

BRIEF DESCRIPTION OF THE DRAWINGS

FIG. 1 is a schematic representation of a prior art muffler on a front wheel drive vehicle.

FIG. 2 is a schematic view of a prior art muffler on a front engine rear wheel drive vehicle.

FIG. 5 is a top plan view of the muffler shown in FIG. 4.

FIG. 6 is a side elevational view of the muffler shown in FIG. 5.

FIG. 7 is a cross-sectional view along line 7—7 in FIG. 6.

FIG. 8 is a schematic representation of a muffler in accordance with the subject invention mounted on a front engine rear wheel drive vehicle.

DETAILED DESCRIPTION OF THE PREFERRED EMBODIMENTS

Figure 3:
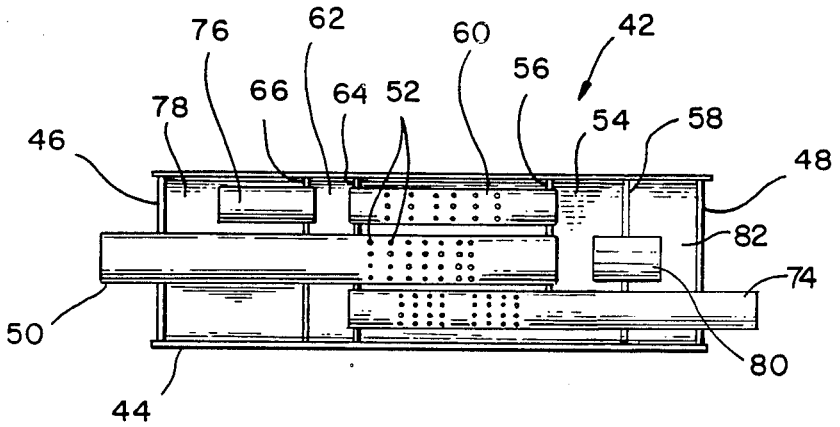
FIG. 3 PRIOR ART
FIG. 3 is a cross-sectional view of a prior art muffler.

A typical prior art muffler is identified by the numeral 10 in FIG. 1. The prior art muffler 10 is schematically illustrated as being transversely mounted in a vehicle 12 having front wheel drive, and a front mounted engine 14. The transverse mounting of the prior art muffler 10 on the vehicle 12 is one of many possible angular alignments of a muffler that may be dictated by the available space on the vehicle 12.

An exhaust pipe 16 is illustrated schematically as extending from the engine 14 to the prior art muffler 10. In actuality, the routing of the exhaust pipe 16 would probably be more circuitous particularly in the vicinity of engine 14 where the exhaust system is competing with other vital vehicular components for the limited available space. As illustrated in FIG. 1, the exhaust pipe 16 would require a substantial bend to approach and enter the transversely mounted prior art muffler 10 substantially parallel to the longitudinal axis of the prior art muffler 10.

Tail pipe 18 extends from the end of muffler 10 which may be opposite the exhaust pipe 16 and continues circuitously to the rear of vehicle 12. More particularly, the tail pipe 18 exits the prior art muffler 10 substantially parallel to the longitudinal axis of the muffler 10, and then undergoes a large bend to continue toward the rear of vehicle 12. In many situations, a second tail pipe 20 extends from the same end of the prior art muffler 10 as the exhaust pipe 16. More particularly, the second tail pipe 20 is initially substantially parallel to the longitudinal axis of prior art muffler 10, and then undergoes a substantially 90° bend as it continues toward the rear of vehicle 12. The bends required to enable the exhaust pipe 16 and the tail pipes 18 and 20 to enter or exit the prior art muffler 10 parallel to its longitudinal axis substantially add to the tubing requirements for the entire exhaust system, with corresponding cost penalties. Additionally, the various bends adjacent to the prior art muffler 10 often minimize the space available for the actual muffler. It is generally more difficult to achieve proper sound attenuation and minimum back pressure in smaller mufflers.

FIG. 2 schematically illustrates prior art mufflers 22 and 24 which comprise portions of a dual exhaust system of a vehicle 26 having a front mounted engine 28 and rear wheel drive. A drive shaft 30 extends from the transmission of engine 28 to a differential 32 which in turn is mounted to axles 34. Exhaust pipes 36 and 38 extend from the engine 28 to the prior art mufflers 22 and 24 respectively. Tail pipes 39 and 40 then extend from the prior art mufflers 22 and 24 to the rear of vehicle 26. The prior art mufflers 22 and 24 must be located sufficiently forward of the rear axles 34 to enable the tail pipes 39 and 40 to undergo an upward bend to achieve sufficient height to clear the axles 34, and then to undergo a rearward bend to continue toward the rear of vehicle 26. As explained previously, the space requirements for these bends in the tail pipes 39 and 40 impose substantial limitations on the sizes possible for the prior art mufflers 22 and 24. The radii of the bends cannot be made too small because of the effect upon back pressure and because of manufacturing limitations.

FIG. 3 shows a typical prior art muffler 42 which is similar to the prior art mufflers 10, 22 and 24 illustrated in FIGS. 1 and 2. The prior art muffler 42 includes an outer shell 44 which is wrapped from one or more sheets of metal, and opposed heads 46 and 48 which are mechanically joined or welded to the outer shell 44. An inlet tube 50 extends through the head 46 to the internal portion of the muffler 42. A portion of inlet tube 50 includes an array of perforations 52. The inlet tube 50 terminates in a reversing chamber 54 defined between baffles 56 and 58. The muffler 42 further includes a perforated return tube 60 which is mounted to the baffle 56 and extends from the reversing chamber 54 to a second reversing chamber 62 defined between baffles 64 and 66. The outlet tube 74 extends from the reversing chamber 62 through the muffler head 48 for connection to the tail pipe (not shown). The prior art muffler 42 further includes a tuning tube 76 which extends from the reversing chamber 62 into a low frequency resonating chamber 78 defined between the baffle 66 and the head 46 of the prior art muffler 42. A second tuning tube 80 is provided at the opposite end of the prior art muffler 42 and extends from the chamber 54 into a second low frequency tuning chamber 82 defined between the baffle 58 and the head 48 of the prior art muffler 42.

Exhaust gases would flow from the exhaust pipe (not shown) into the inlet tube 50 of the prior art muffler 42. The exhaust gases would then flow through the reversing chamber 54, into the return tube 60, through the second reversing chamber 62 and into the outlet tube 74 and tail pipe. However, there would be a certain amount of intended cross flow between the arrays of perforations in the tubular members between baffles 56 and 64. The tuning tubes 76 and 80 and the low frequency resonating chambers 78 and 82 would contribute to the attentuation of certain narrow ranges of sound frequencies that are not properly attenuated by the flow of exhaust gases through the perforated tubes within the prior art muffler 42. As explained previously, and as shown graphically in FIG. 3, the typical prior art muffler 42 includes a large number of separate parts that are assembled in a labor intensive process. Furthermore, cost and mechanical constraints virtually require the inlet and outlet 50 and 74 of the prior art muffler 42 to be disposed in the opposed heads 46 and 48 of the prior art muffler 42. In extreme situations, the inlet and/or the outlet could be extended through the wrapped outer wall 44 of the prior art muffler 42, but this would necessitate various structural modifications to the prior art muffler to ensure that the wrapped outer shell 44 provided the necessary support and to ensure that a secure connection of the inlet or outlet to the wrapped outer wall 44 could be made.

Figure 4:
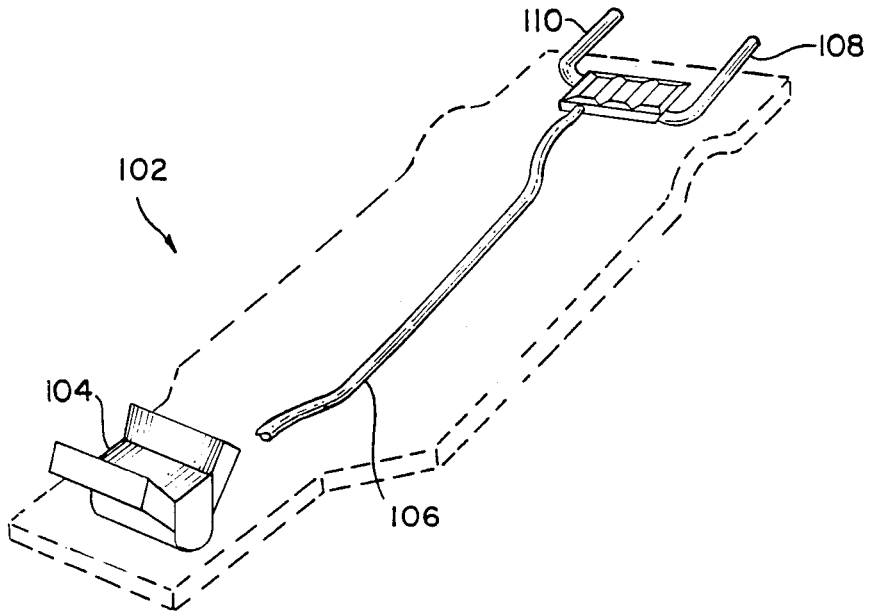
FIG. 4 is a schematic representation of a muffler in accordance with the subject invention on a front wheel drive vehicle.

The muffler of the subject invention is identified generally by the numeral 100 in FIG. 4, and is schematically illustrated as being transversely mounted on a front wheel drive vehicle 102 having a front mounted engine 104. The muffler 100 will be described herein as being stamp formed from metallic sheets. However, it will be understood that the muffler may be molded from certain high temperature plastics. The exhaust pipe 106 is illustrated schematically as extending from the engine 104 to the muffler 100. In actuality, the alignment of the exhaust pipe 106 in the vicinity of the engine 104 typically would be more circuitous than illustrated in FIG. 4. However, once the exhaust pipe 106 is free of the compartment in which the engine 104 is mounted, a substantially straight alignment of the exhaust pipe 106 can be provided. More particularly, the exhaust pipe 106 can follow a substantially straight path along the portion of the vehicle that would be devoted to a drive shaft on a rear wheel drive vehicle. The exhaust pipe 106 enters the stamp formed muffler 100 substantially perpendicular to the longitudinal axis of the stamp formed muffler 100. Furthermore, the exhaust pipe 106 may enter the stamp formed muffler 100 substantially adjacent one longitudinal end of the stamp formed muffler 100.

The stamp formed muffler 100 further includes a pair of tail pipes 108 and 110 extending therefrom. The first tail pipe 108 is aligned substantially perpendicular to the longitudinal axis of the stamp formed muffler 100 and is disposed substantially adjacent the end of the stamp formed muffler 100 opposite the exhaust pipe 106. Thus, the exhaust pipe 106 and the tail pipe 108 are approximately parallel to one another and are approximately perpendicular to the longitudinal axis of the stamp formed muffler 100. Furthermore, the exhaust pipe 106 and the tail pipe 108 are offset from one another by a distance substantially equal to the overall length of the stamp formed muffler 100. The second tail pipe 110 leaves the stamp formed muffler 100 at an acute angle to the longitudinal axis of the stamp formed muffler 100. Additionally, the second tail pipe 110 is disposed at the end of the stamp formed muffler 100 closest to the exhaust pipe 106.

The configuration of the stamp formed muffler 100 and the alignment of the exhaust pipe 106 and the tail pipes 108 and 110 is extremely efficient, as shown in FIG. 4. More particularly, the exhaust pipe 106 extends substantially straight from the compartment of engine 104 and does not undergo the sweeping 90° bend required in the prior art embodiment illustrated in FIG. 1. Similarly, the tail pipe 108 leaves the stamp formed muffler 100 at an alignment approximately parallel to the longitudinal axis of the vehicle 102, and thus is not required to undergo the sweeping 90° turn required in the prior art exhaust system illustrated in FIG. 1. Similarly, the tail pipe 110 leaves the muffler 100 at an acute angle to the longitudinal axis of the muffler 100, thus again eliminating the sweeping bend required with the prior art. The avoidance of these bends in the exhaust pipe 106 and the tail pipes 108 and 110 saves the expensive tubular materials and can facilitate manufacturing and installation process. Furthermore, the absence of the broad sweeping tubular bend enables a muffler of greater dimensions to be employed, if necessary, to achieve the desired sound attenuation and back pressure levels.

The stamp formed muffler 100 is illustrated in greater detail in FIGS. 5–7. More particularly, the stamp formed muffler 100 is of a generally elongated rectangular configuration including opposed longitudinal ends 112 and 114 and opposed sides 116 and 118. The muffler 100 comprises a pair of stamp formed external shells 120 and 122 and a pair of stamp formed internal plates 124 and 126. The external shells 120, 122 and the internal plates 124, 126 preferably are stamp formed from 0.034 inch thick aluminized or stainless steel. As illustrated in FIGS. 5–7, the external shells 120 and 122 are stamp formed to be virtual mirror images of one another. Similarly, the internal plates 124 and 126 are stamp formed to be mirror images of one another. However, as will be explained further below, this symmetry is not required.

The external shell 120 is stamp formed to define a peripheral flange 128, which in this embodiment is generally planar. The external shell 120 is further stamp formed to define low frequency resonating chambers 130 and 132 adjacent respectively the opposed ends 112 and 114 of the stamp formed muffler 100. Additionally, the external shell 120 is stamp formed to define an expansion chamber 134 between the low frequency resonating chambers 130 and 132.

Between the low frequency resonating chamber 130 and the expansion chamber 134, the external shell 120 includes a generally planar portion 136 which lies substantially in the same plane as the peripheral flange 128. However, extending upwardly from the planar portion 136 and connecting the low frequency resonating chamber 130 with the expansion chamber 134 are arcuate channels 138, 140 and 142. As will be explained further below, the arcuate channels 138–142 will substantially surround channels stamp formed in the internal plate 124. Similarly, the external shell 120 includes a generally planar portion 144 between the low frequency resonating chamber 132 and the expansion chamber 134. The planar portion 144 lies approximately in the same plane as the peripheral flange 128. However, generally arcuate channels 146 and 148 extend upwardly from the planar portion 144 and the peripheral flange 128 to connect the low frequency resonating chamber 132 with the expansion chamber 134. As explained previously, the arcuate portions 146 and 148 will engage corresponding arcuate portions stamp formed in the internal plate 124. The external shell 120 is further stamp formed to define an arcuate portion 150 to engage the exhaust pipe 106 and arcuate portions 152 and 154 to engage the tail pipes 108 and 110 respectively.

As shown in FIG. 7, the internal plate 124 is stamp formed to define an array of channels. When the internal plate 124 is mated with the internal plate 126, the channels will define an array of tubes through which exhaust gases may flow. More particularly, the internal plate 124 is stamp formed to define an inlet 156 which is aligned generally perpendicular to the longitudinal axis of the muffler 100, and which is dimensioned to mate with the exhaust pipe 106. The tubular array stamp formed in internal plate 126 undergoes a substantially 90° bend adjacent inlet 156 to define inlet channel 158 which is substantially parallel to the longitudinal axis of the muffler 100. The inlet channel 158 is provided with an array of perforations 160 which extend through the internal plate 124. The perforations 160 are disposed in a portion of the inlet channel 158 which will lie within the area defined by the expansion chamber 134 stamp formed into the external shell 120. The internal plate 124 is further stamp formed to define a return channel 162 which is substantially parallel to the inlet channel 158 and is connected thereto by a reversing channel 164 which defines a substantially 180° bend. The return channel 162 is provided with an array of perforations 163 which are disposed to lie in the expansion chamber 134 stamp formed into the external shell 120. Outlet channels 166 and 168 communicate with the return channel 162 by means of a connecting channel 170. The outlet channels 166 and 168 are substantially parallel to the inlet channel 158 and the return channel 162. The outlet channel 168 terminates at an outlet 172 which is aligned substantially perpendicular to the longitudinal axis of the muffler 100 and substantially adjacent the end 114 thereof. The outlet channel 166 terminates at an outlet 174 which is aligned at an acute angle to the longitudinal axis of the muffler 100 and at end 112.

The internal plate 124 is further stamp formed to define a tuning tube 176 which extends in a longitudinal direction from the reversing channel 164 between the inlet channel 158 and the return channel 162. The tuning channel 176 terminates at an aperture 178 which is disposed to lie within the low frequency resonating chamber 132 stamp formed in the external shell 120. Similarly, the internal plate 124 is provided with a tuning channel 180 which extends from the return channel 162 and terminates at an aperture 182. The aperture 182 will be substantially in line with the low frequency chamber 130 stamp formed in the external shell 120.

The muffler 100 is assembled by first connecting the internal plates 124 and 126 to one another by welding or other suitable means such that the respective channels stamp formed therein define an array of tubes through which the exhaust gases will flow. The external shells 120 and 122 then are affixed around the internal plates 124 and 126. In this assembled condition, the arcuate channels 138, 140 and 142 will engage the outlet channel 166, the tuning channel 180 and the inlet channel 158 respectively. Thus, the tuning tube 180 will communicate with the low frequency resonating chamber 130 stamp formed in the external shell 120. In a similar manner, the arcuate channels 146 and 148 of the external shell 120 will engage the outlet channel 168 and the tuning channel 176 respectively of the internal plate 124. As a result, the tuning tube 176 will communicate with the low frequency resonating chamber 132 through the aperture 178. The perforation arrays 160 and 163 will lie within the expansion chamber 134 and will permit a flow of exhaust gases therethrough with a corresponding sound attenuation.

The muffler 100 is mounted on the vehicle as shown in FIG. 4. Based on the preceding description of muffler 100, it is seen that the tubes within muffler 100 run generally transverse to the length of vehicle 102. However, the inlet and outlets are angularly aligned to the tubes to achieve the most efficient routing of the exhaust pipe and tail pipes.

Alternate embodiments of the muffler of the subject invention are illustrated schematically in FIG. 8 and are referred to by the numerals 200 and 202. The mufflers 200 and 202 may be mirror images of one another, and are mounted to a vehicle 204 having a front mounted engine 206 and rear wheel drive. The rear wheel drive is achieved through a drive shaft 208 which extends from the engine 206 to a differential joint 210. Exhaust pipes 212 and 214 extend from the engine 206 to the mufflers 200 and 202 respectively. Similarly, tail pipes 216 and 218 extend from mufflers 200 and 202 to the rear of vehicle 204. The mufflers 200 and 202 may be of an elongated pentagonal shape such that the longitudinal axis of the mufflers 200 and 202 are generally parallel to the drive shaft 208 of the vehicle 204. Furthermore, the mufflers 200 and 202 are positioned to generally conform to the shape of the available space between the drive shaft 208, the differential 210, and the axle 220. Additionally, the exhaust pipes 212 and 214 extend respectively into one end of the mufflers 200 and 202, while the tail pipes 216 and 218 extend out of the top surfaces of the respective mufflers 200 and 202. Thus, the tail pipes 216 and 218 are angularly aligned with respect to the longitudinal axis of the mufflers 200 and 202 and to the corresponding exhaust pipes 212 and 214.

Figure 9:
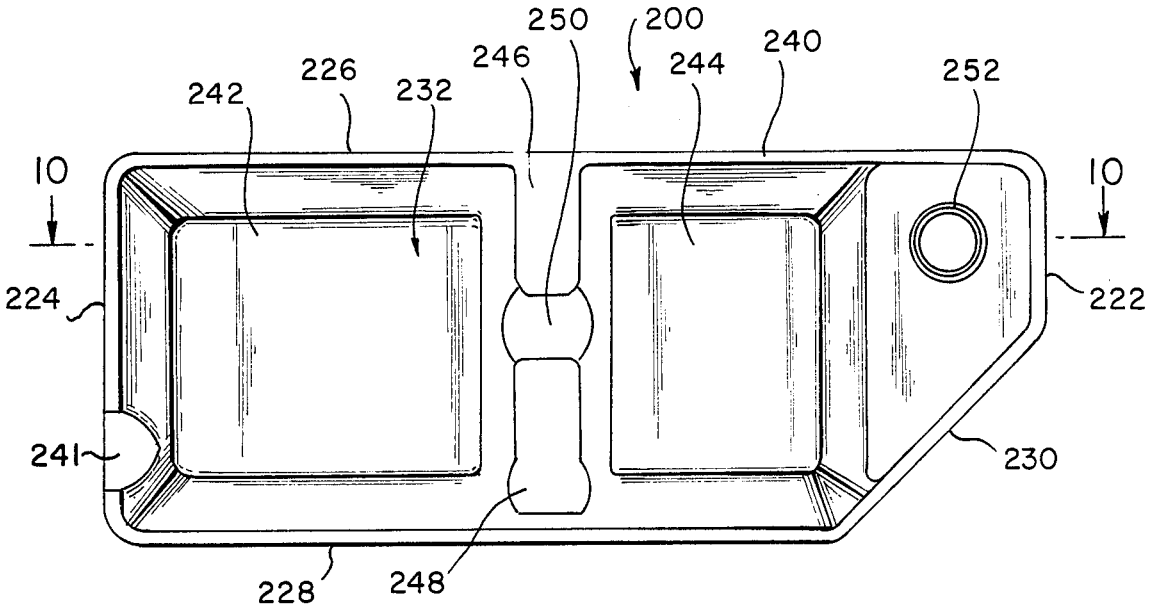
FIG. 9 is a top plan view of the muffler shown in FIG. 8.
Figure 10:
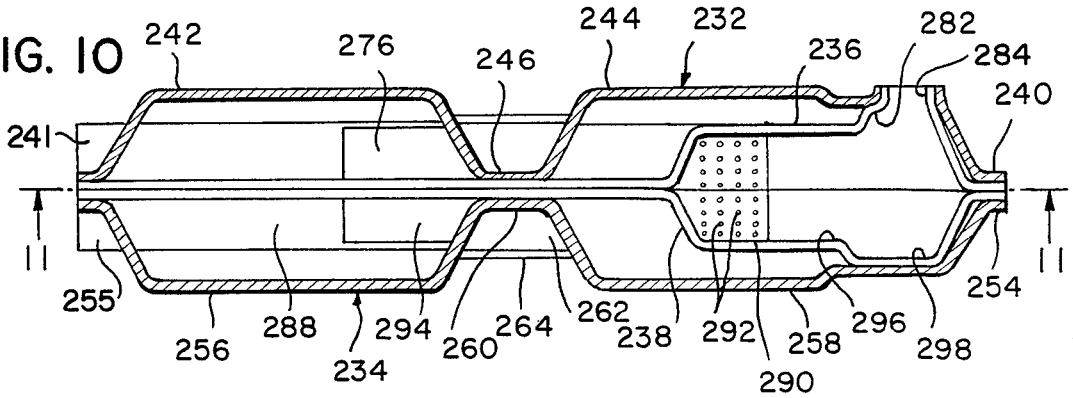
FIG. 10 is a cross-sectional view taken along line 10—10 in FIG. 9.
Figure 11:
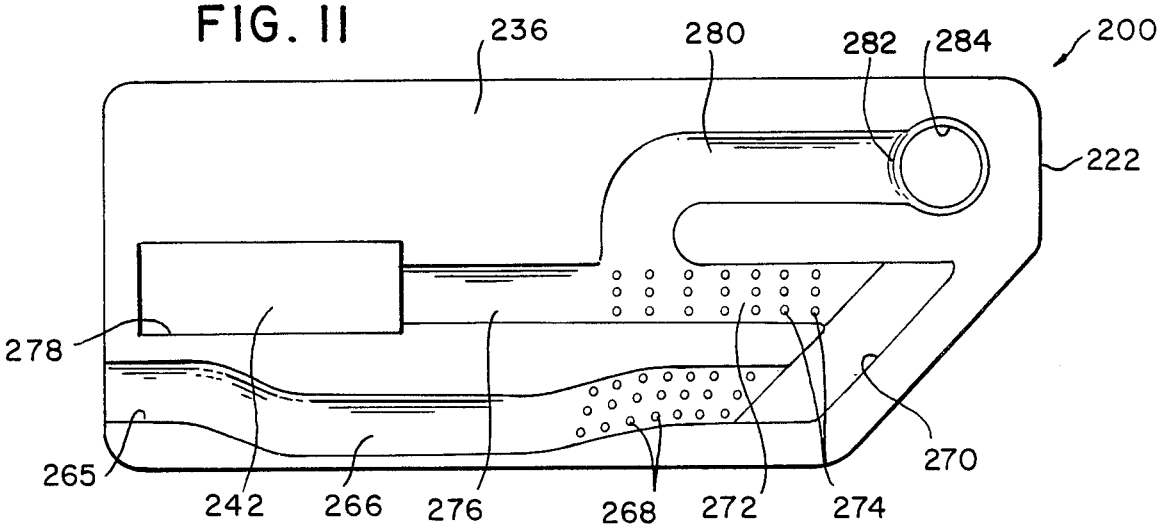
FIG. 11 is a cross-sectional view taken along line 11—11 in FIG. 10.

The muffler 200 illustrated schematically in FIG. 8 is shown in greater detail in FIGS. 9–11. More particularly, the muffler 200 is of elongated pentagonal configuration and includes opposed generally parallel ends 222 and 224 and opposed generally parallel sides 226 and 228. Side 230 of muffler 200 extends between end 222 and side 228 and defines an angle of approximately 45° with respect to the longitudinal axis of the muffler.

The muffler 200 includes stamp formed external shells 232 and 234 and stamp formed internal plates 236 and 238. The external shell 232 includes a peripheral flange 240 which, in this embodiment, is generally planar. However, the peripheral flange 240 includes an arcuate inlet channel 241 which will engage the exhaust pipe of the vehicle. The external shell 232 is further stamp formed to define a low frequency resonating chamber 242 and an expansion chamber 244. A generally planar portion 246 is disposed between the low frequency resonating chamber 242 and the expansion chamber 244 and lies substantially in the same plane as the peripheral flange 240. Generally arcuate channels 248 and 250 extend upwardly from the planar portion 246 and connect the low frequency resonating chamber 242 with the expansion chamber 244. As will be explained further below, the arcuate channels 248 and 250 will closely engage channels stamp formed in the internal plate 236. The external shell 232 is further stamp formed to define an outlet aperture 252.

The external shell 234 is generally similar to the external shell 232, and includes a generally planar peripheral flange 254 having an inlet channel 255. Additionally, the external shell 234 includes a low frequency resonating chamber 256 and an expansion chamber 258. A generally planar portion 260 is disposed between the low frequency resonating chamber 256 and the expansion chamber 258 and lies substantially in the same plane as the peripheral flange 254. Arcuate channels 262 and 264 extend between the low frequency resonating chamber 256 and the expansion chamber 258. Unlike the external shell 232, the external shell 234 does not include an outlet aperture.

The internal plate 236, as shown most clearly in FIG. 11, includes an inlet 265 which leads to an inlet channel 266. The inlet channel 266 includes an array of perforations 268 which are disposed to lie within the expansion chamber 244 of the external shell 232. The inlet channel 266 terminates at an aperture 270 which also is disposed to lie within the expansion chamber 244. The internal plate 236 is further stamp formed to define a return channel 272 which extends generally parallel to the longitudinal axis of the muffler 200. More particularly, the return channel 272 extends from the aperture 270 and includes an array of perforations 274 which are disposed to lie within the expansion chamber 244 of the stamp formed external shell 232. A tuning channel 276 extends generally collinearly from the return channel 274 and terminates at an aperture 278 which is disposed to lie within the low frequency resonating chamber 242 stamp formed in the external shell 232. An outlet channel 280 extends from the return channel 272 toward the end 222 of the muffler 200. The return channel terminates in a recessed portion 282 which is stamp formed to a depth to lie substantially in face to face contact with the expansion chamber 244 of external shell 232. The internal plate 236 is further stamp formed to define an outlet 284 in the recessed portion 282 of outlet channel 280. The outlet 284 is disposed to be in register with the outlet aperture 252 of the outer shell 232.

The internal plate 238 is very similar to the internal plate 236, and is stamp formed to include an inlet channel 288, a return channel 290 having an array of perforations 292 therein, a tuning channel 294 and an outlet channel 296. The outlet channel 296 of the internal plate 238 terminates in a recessed portion 298. However, unlike the recessed portion 282 of the internal plate 236, the recessed portion 298 is not stamp formed to define an outlet aperture.

The muffler 200 is assembled by joining by mechanical or other means, such as spot welding, the internal plates 236 and 238 in face to face relationship such that the arrays of channels therein define an array of tubes through which the exhaust gases may travel. The stamp formed external shells 232 and 234 then are welded or mechanically joined around the internal plates 236 and 238. As a result of this assembly, the perforations in the internal plates 236 and 238 will lie within the expansion chambers 244, 258 stamp formed in the external shells 232 and 234. Similarly, the tuning tube formed by tuning channels 276 and 294 will communicate with the low frequency resonating chamber 242, 256 stamp formed in the external shells 232 and 234. Additionally, the outlet 284 of the internal plate 236 will be in register with the outlet aperture 252 stamp formed in the external shell 232.

It should be noted that the muffler 200 described above and illustrated in FIGS. 9–11 can be manufactured as the mirror image muffler 202 by stamp forming the outlet 284 through the recessed portion 298 of outlet channel 296, and by keeping the recessed portion 282 of outlet channel 280 substantially continuous. Similarly, an outlet aperture can be stamped through external shell 234 rather than through external shell 232. This embodiment, therefore, enables the mufflers 200 and 202 to be formed from exactly the same dies, with the only difference being the particular members through which the outlets are stamped.

In summary, a stamp formed muffler is provided with inlets and outlets that are angularly oriented with respect to the longitudinal axis of the muffler and/or with respect to one another. The stamp formed muffler comprises a pair of internal plates which are stamp formed to define an array of channels such that when the stamp formed internal plates are disposed in face to face contact, the stamp formed channels define an array of tubes through which exhaust gases may travel. The channels and thus the tubes formed thereby include at least one inlet and at least one outlet which may be angularly aligned to the inlet. The stamp formed muffler further includes at least one external shell which is stamp formed to define at least one chamber surrounding selected portions of the channels stamp formed into the internal plates. In certain embodiments, the inlets and outlets of the muffler lie substantially along the seam between the stamp formed plates and/or shells. In other embodiments, however, at least one of the inlets or outlets are stamp formed to extend through locations that are spaced from the seams between the stamp formed members.

While the invention has been described with respect to certain preferred embodiments, it is apparent that various changes can be made without departing from the scope of the invention as defined by the appended claims.

What is claimed is:

1. An exhaust muffler for connection to at least one exhaust pipe and at least one tail pipe of a vehicle, said muffler comprising:

a pair of internal plates disposed in generally face to face relationship, said internal plates being formed to define an array of tubes therebetween, with portions of said array of tubes being perforated, said tubes defining at least one inlet to said array of tubes connectable to said exhaust pipe and at least one outlet from said array of tubes connectable to said tail pipe, said outlet being angularly aligned with respect to said inlet with the respective alignments of said inlet and said outlet being selected to achieve efficient alignment of the exhaust pipe and tail pipe of the vehicle; and a pair of external shells securely connected to one another and surrounding and enclosing said internal plates, said external shells being formed to define at least one inlet and at least one outlet in register with each said respective inlet and outlet of said internal plates, said external shells defining at least one expansion chamber surrounding the perforated portions of said internal plates.

2. An exhaust muffler as in claim 1 wherein said internal plates and said external shells each include a peripheral edge, and wherein at least one of said inlet and said outlet is defined adjacent the peripheral edges of said internal plates and said external shells.

3. An exhaust muffler as in claim 2 wherein at least one of said external shells is formed to define a low frequency resonating chamber spaced from said expansion chamber and wherein said array of tubes comprises a tuning tube extending into and communicating with said low frequency resonating chamber.

4. An exhaust muffler as in claim 3 wherein at least one of said internal plates is formed to define an aperture adjacent a portion of said tuning tube disposed in said low frequency resonating chamber, said aperture defining the communication between the tuning tube and the low frequency resonating chamber.

5. An exhaust muffler as in claim 3 comprising a plurality of outlets angularly aligned with respect to one another.

6. An exhaust muffler as in claim 5 wherein one said outlet is substantially parallel to and spaced from said inlet.

7. An exhaust muffler as in claim 1 wherein said internal plates and said external shells each comprise a peripheral edge, at least one of said inlets and outlets is disposed at a location spaced from the peripheral edges of said internal plates and the peripheral edges of said external shells.

8. An exhaust muffler as in claim 7 wherein at least one of said external shells is stamp formed to define a low frequency resonating chamber spaced from said expansion chamber, and wherein said array of tubes comprises a tuning tube extending into and communicating with said low frequency resonating chamber.

9. An exhaust muffler as in claim 7 being of generally non rectangular plan configuration.

10. An exhaust muffler as in claim 1 wherein said internal plates and said external shells are stamp formed from metallic material.

11. A muffler for an exhaust system of a vehicle, said exhaust system comprising at least one exhaust pipe and at least one tail pipe, said muffler comprising: a pair of formed plates disposed in generally face to face relationship, said plates being formed to define an array of tubes therebetween, said array of tubes comprising a plurality of generally parallel tubes in communication with one another, an inlet in communication with said parallel tubes and connectable to the exhaust pipe, and an outlet in communication with said parallel tubes and connectable to the tail pipe, said inlet and outlet being angularly aligned to said parallel tubes of said formed plates to facilitate alignment of said exhaust pipe and said tail pipe adjacent said muffler, at least one of said plates being formed to define perforations therethrough in said array of tubes; and at least one external shell formed to define at least one expansion chamber, said external shell being fixedly mounted to one of said internal plates such that the expansion chamber surrounds the perforations of said one of the internal plates.

12. A muffler as in claim 11 wherein said plates include peripheral edges and wherein said inlet is disposed at a location adjacent the peripheral edges of said plates.

13. A muffler as in claim 11 wherein said plates include peripheral edges and wherein said outlet is disposed at a location on one said plate spaced from the peripheral edges of said plates.

14. A muffler as in claim 11 wherein said inlet is generally perpendicular to said parallel tubes.

15. A muffler as in claim 11 comprising two outlets.

16. A muffler as in claim 11 wherein said plates and said at least one external shell is stamp formed from metal.

17. An exhaust muffler for connection to an exhaust pipe and a tail pipe of a vehicle and for mounting in a selected non rectangular space envelope on a vehicle, said muffler comprising a pair of formed plates disposed in generally face to face relationship, said plates being formed to define an array of tubes including an inlet to the muffler connectable to the exhaust pipe and an outlet from the muffler connectable to the tail pipe, said inlet and said outlet being angularly aligned relative to one another, selected portions of said tubes being formed to define perforations therethrough, said plates being formed to define substantially identical non rectangular peripheries, generally conforming in shape to the non rectangular space envelope in the vehicle, said muffler further comprising at least one external shell securely connected to one of said plates, said external shell being formed to define at least one expansion chamber surrounding said perforations of the tubes adjacent thereto.

18. A muffler as in claim 17 comprising a pair of external shells substantially surrounding said plates.

19. A muffler as in claim 18 wherein the external shells are formed to define a non rectangular periphery substantially similar to the non rectangular periphery of the plates.

20. A muffler as in claim 19 wherein the plates and the external shells are formed to define a pentagonal periphery.

21. A muffler as in claim 19 wherein the outlet of the tubular array defined between said formed plates is at a location spaced from the periphery of one of said plates and wherein one of said external shells is formed to define an outlet aperture in register with the outlet of the array of tubes formed in the plates.

22. A muffler as in claim 17 wherein said plates and said at least one external shell are stamp formed from metal.

23. An exhaust muffler for connection to at least one exhaust pipe and at least one tail pipe of a vehicle, said muffler comprising a pair of internal plates disposed generally in face to face relationship, said internal plates being formed to define an array of tubes therebetween, said tubes defining at least one inlet connectable to said exhaust pipe and at least one outlet connectable to said tail pipe, a pair of external shells each being formed to define a generally planar peripheral flange and at least one chamber extending from the plane of said peripheral flange, the peripheral flanges of said external shells being connected to one another such that said external shells substantially surround and enclose said internal plates, said external shells further defining at least one inlet and at least one outlet in register with each said respective inlet and outlet of said internal plates, at least one of said inlets and said outlets being angularly aligned to the plane of the connected peripheral flanges, whereby the alignment of said inlet and said outlet is selected in accordance with a desired alignment of the exhaust pipe and tail pipe of the vehicle.

24. An exhaust muffler as in claim 23 wherein one of said inlets and said outlets angularly aligned to the plane of the connected peripheral flanges is disposed at a location spaced from said peripheral flanges.

25. An exhaust muffler as in claim 23 wherein the peripheral flanges of said external shells are of non-rectangular plan view configuration.

* * * * *